United States Patent [19]

Sutherland et al.

[11] 4,356,719

[45] Nov. 2, 1982

[54] MANDREL JAW AND METHOD OF MANUFACTURE

[75] Inventors: Clarke R. Sutherland, East Bridgewater; Frederick A. Skinner, Peabody, both of Mass.

[73] Assignee: USM Corporation, Farmington, Conn.

[21] Appl. No.: 157,226

[22] Filed: Jun. 9, 1980

[51] Int. Cl.[3] ..... B21D 28/10; B21D 43/28

[52] U.S. Cl. ..... 72/391; 72/336; 72/404

[58] Field of Search ..... 72/391, 114, 334, 335, 72/336, 338, 324, 332, 404; 113/119; 29/566.1

[56] References Cited

U.S. PATENT DOCUMENTS

| | | | |
|---|---|---|---|
| 26,144 | 11/1859 | Doolittle | 72/335 |
| 3,095,106 | 6/1963 | Morrison | 72/391 |
| 3,154,210 | 10/1964 | Elliott | 72/391 |
| 3,292,412 | 12/1966 | Costabile | 72/335 |
| 3,324,700 | 6/1967 | Elliott | 72/391 |
| 3,363,445 | 1/1968 | Sanders | 72/391 |
| 3,646,800 | 3/1972 | Martin | 72/391 |
| 3,768,297 | 10/1973 | Martin | 72/391 |
| 3,886,782 | 6/1975 | Miyamoto | 72/391 |
| 4,117,710 | 10/1978 | Fluester | 72/391 |
| 4,118,969 | 10/1978 | Corbett | 72/391 |
| 4,131,009 | 12/1978 | Hara | 72/391 |
| 4,136,547 | 1/1979 | Ewig | 72/391 |
| 4,137,747 | 2/1979 | Clarke | 72/391 |
| 4,177,710 | 12/1979 | Matuschek | 85/70 |

FOREIGN PATENT DOCUMENTS

| | | | |
|---|---|---|---|
| 418604 | 10/1934 | United Kingdom | 113/119 |

*Primary Examiner*—Gene Crosby

*Attorney, Agent, or Firm*—Owen J. Meegan

[57] ABSTRACT

A mandrel jaw and a process for forming it from a strip of steel including the steps of forming a shape, bending portions of the shape and then stamping the bent body into the configuration of the jaw.

16 Claims, 6 Drawing Figures

MANDREL JAW AND METHOD OF MANUFACTURE

FIELD OF THE INVENTION

The present invention relates to mandrel jaws for use with riveting tools to set rivets and methods of making such jaws.

BACKGROUND OF THE INVENTION

Riveting tools for placing blind rivets have a tubular jaw housing in which a mandrel jaw is slidably disposed. The mandrel jaws are slidable coaxially under spring influence to cause the jaw members to cooperate with inclined internal faces of the jaw housing. The jaws tend to move radially inwardly to grip a rivet mandrel therebetween and each of the jaw members has faces at its end which converge towards its radial inner or mandrel gripping face for cam-wise cooperation with complimentary faces in the jaw carrier and in the nose or tip of the tool to move the jaws apart radially to receive the stem of a mandrel between them when the jaw housing is fully advanced to the nose or the tip of the tool. Such rivet setting tools and mandrel jaws are disclosed in the U.S. Pat. No. to Elliott, 3,324,700.

DESCRIPTION OF THE PRIOR ART

Mandrel pulling jaws as commonly made in the art have utilized expensive casting techniques and subsequent machining to remove flashing. They have also been made on screw machines and lathes. Cast and machined jaws are commonly accepted in the art, but we have found that they tend to wear more readily than the stamped and pressed mandrel jaws of the present invention. Moreover, the existing methods of manufacturing the parts produces such parts only in the order of hundreds per hour whereas with the stamping and folding techniques disclosed herein such parts can be produced in many thousands per hour and be equal or superior in quality at a significant reduction in manufacturing costs.

SUMMARY OF THE INVENTION

The present invention relates to mandrel pulling jaws for setting rivets, each of which is formed in a generally hemi-conical shape. The jaw includes a central body initially formed in a generally triangular shape with first and second arms extending therefrom, the first arm being shorter than the second. The first arm is folded over and disposed on the central body and the second arm is folded over and disposed on the first arm. A central groove is formed within the second arm and extends on the axis of the cone from the apex of the jaw to the base. A plurality of substantially parallel teeth are formed within the groove, transverse to the axis of the cone.

DESCRIPTION OF THE PREFERRED EMBODIMENTS

Figure 1:
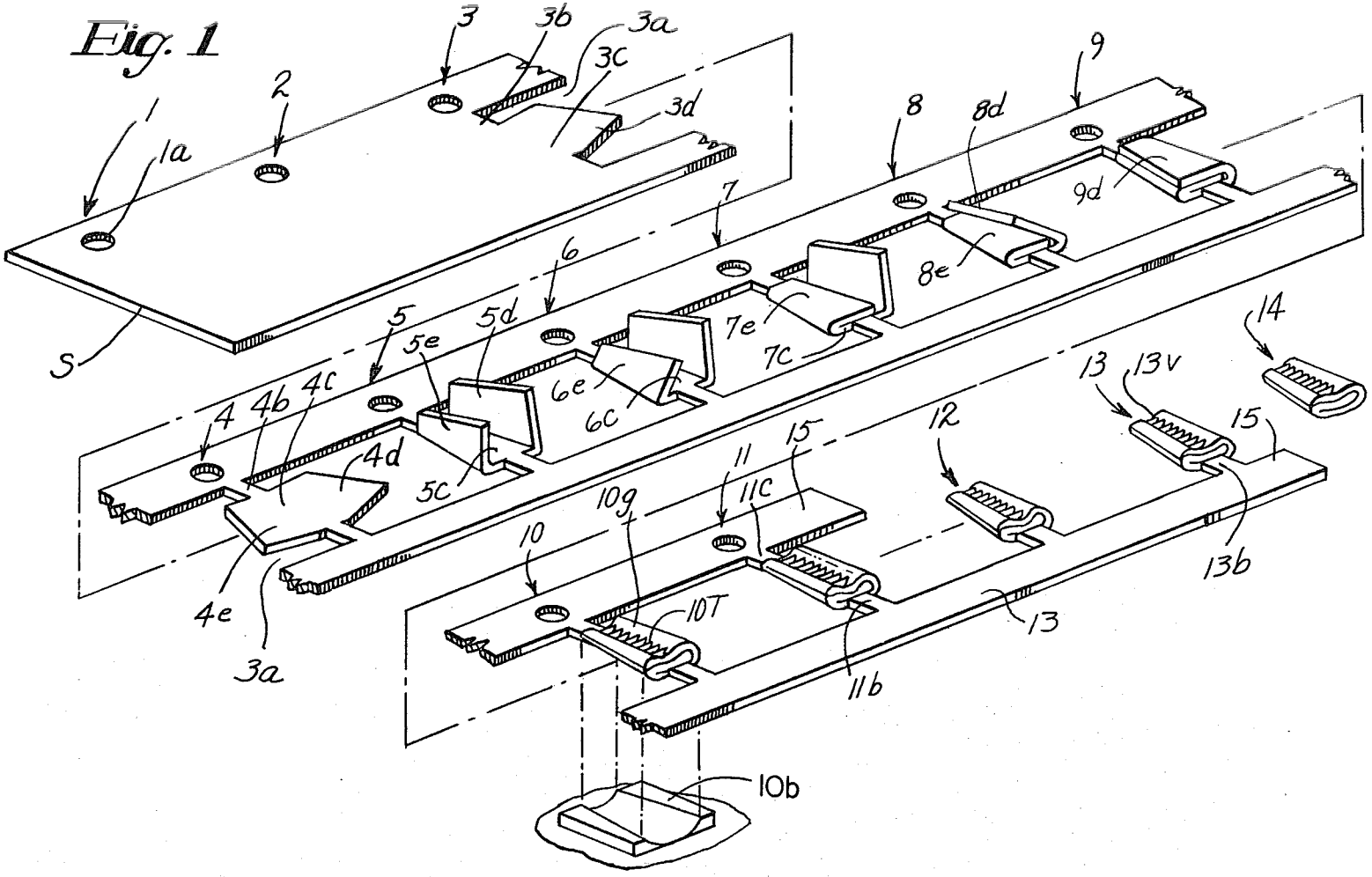
FIG. 1 is a view of a progressive stamping of a strip to form the mandrel jaw of the present invention.

FIG. 1 shows a step by step process of a progressive metal stamping operation which cuts, bends and forms portions of a metal strip into the shape of the mandrel jaw of the present invention. It is to be understood that although this figure will be described herein as a progression from left to right, the first made piece is at stage 14 in the drawing and the last made piece is at stage 1. Also, although the strip is shown broken into three parts, the process utilizes a single strip of metal and the divisions are solely for the purpose of illustration.

In operation, the metal strip S, generally of a predetermined thickness of 0.045 to 0.050 is fed into a conventional metal stamping press and an indexing hole 1*a* is first formed on the edge of the strip in location 1. The strip S is then advanced through the stages using these indexing holes. In stages 2 & 3 of the stamping operation, the area 3*a* is removed to form a portion of the temporary support 3*b*, a portion of the central body 3*c* and the long arm 3*d*. Simultaneously, the removal of the portion 3*a* forms the short arm 4*e* in the piece next adjacent together with the balance of the body 4*c* that was formed in the prior stage.

In stage 5, the arms 5*e* and 5*d* are bent to a position perpendicular to the body 5*c*, the body 5*c* being formed into a generally triangular shape having a wider bottom than top. In stage 6 the shorter arm 6*e* is bent towards the body 6*c* until it rests upon the central body 6*c*, as shown in stage 7 as 7*e*. The longer arm 8*d* is then folded over the shorter arm 8*e* in stage 8 until it rests thereon as shown in stage 9.

In stage 10, (an extension of stage 9) the folded body is stamped into a hemi-conical shape by the mutual coaction of a male die (shown as 40 in FIG. 5) and a female die 10*b*. A mandrel receiving groove 10*g* is disposed on the axis of the cone forming the jaw and the teeth 10*t* are located transversely thereto. At the same stage a bevel (best shown in FIG. 2, number 33) is also formed in the body as described below. In stage 11 the mandrel jaw is stamped again to ensure the generally hemi-conical shape and in location 12 the runner support 15 and the temporary support 11*c* is sheared away together with the associated support runner. At location 13 a bevel 13*v* (shown as 34 in FIGS. 2 & 3) is formed in the mandrel jaw as described below and at stage 14, temporary support 13*b* is sheared away to form the mandrel jaw.

Figure 2:
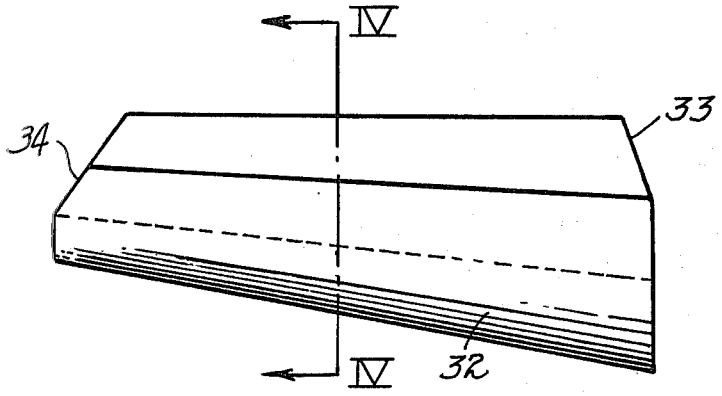
FIGS. 2 and 3 are side and top views of the mandrel jaw.
Figure 3:
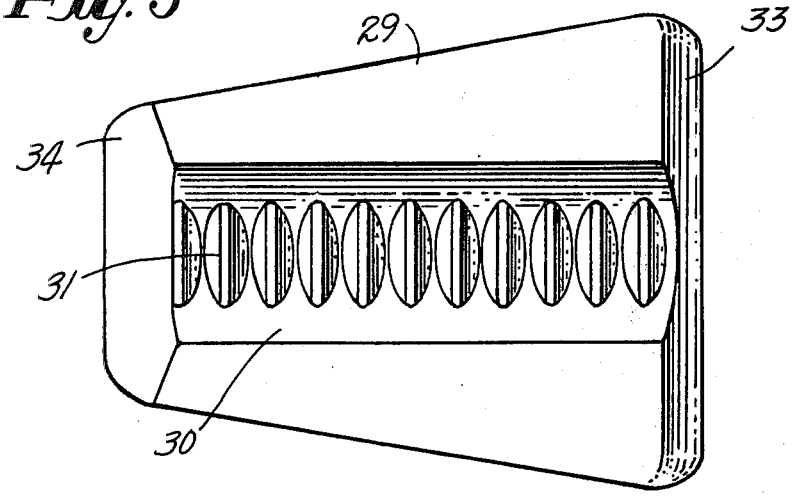
Figure 4:
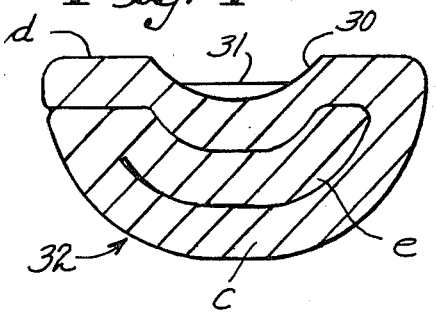
FIG. 4 is a cross section taken along the line 4—4 of FIG. 2.

As shown in FIGS. 2, 3 and 4 each jaw has a flat side 29 with a central mandrel receiving groove 30 having sharp-edged corrugations or teeth 31 extending transversely of the groove 30. The outer area of each jaw is tapered in a manner generally concentric with the groove 30, as has been described previously, in a generally hemi-conical shape. A plane face 33 is located at the larger end of the jaw and inclined towards the smaller end of the jaw as viewed from the outer surface 32 toward the groove 30. Although the jaw is shown to have a smooth hemi-conical shape, a modification may be made by forming a flat face parallel to the groove 30 along one quarter to one half of its length to prevent rotation of the jaws as they move within a chuck having a corresponding flat surface formed therein. An inclined end face 34 may also be formed on the narrower end of the jaw to aid in receiving and directing a mandrel into the channel 30 as the tool is being used.

As shown in FIG. 4, the mandrel jaw is formed on the central body c with the short arm e disposed immediately adjacent thereto and the long arm d wrapped over the short arm e as shown in FIG. 1. The central groove 30 has been stamped in the jaw together with the teeth 31.

Figure 5:
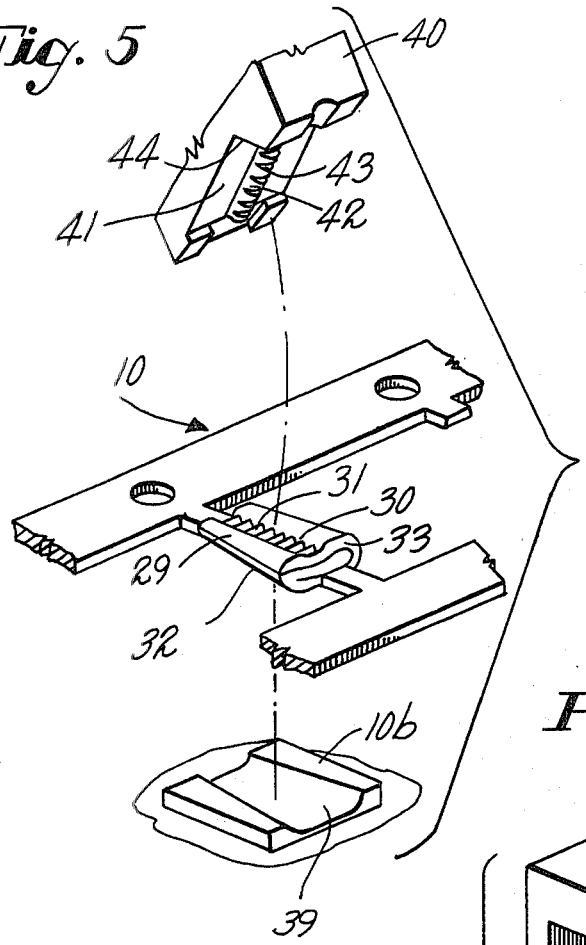
FIG. 5 is an enlarged view of stage 10 showing means for stamping the folded body to form the desired shape.

FIG. 5 illustrates in further detail stage 10 of the stamping operation, in which a conventionally operating male die 40 coacts with the female die **10*b* to stamp the folded body into a hemi-conical shape. As shown, concave surface 39 of female die 10*b* acts to shape outer surface 32 of the folded body into a hemi-conical configuration, while surface 41 of male die 40 stamps flat side 29. A ridge 42 having transverse grooves 43 forms mandrel receiving groove 30 having sharp edged teeth 31. At the same stage, bevel 33 may be formed by providing inclined surface 44 of the male die 40**.

Figure 6:
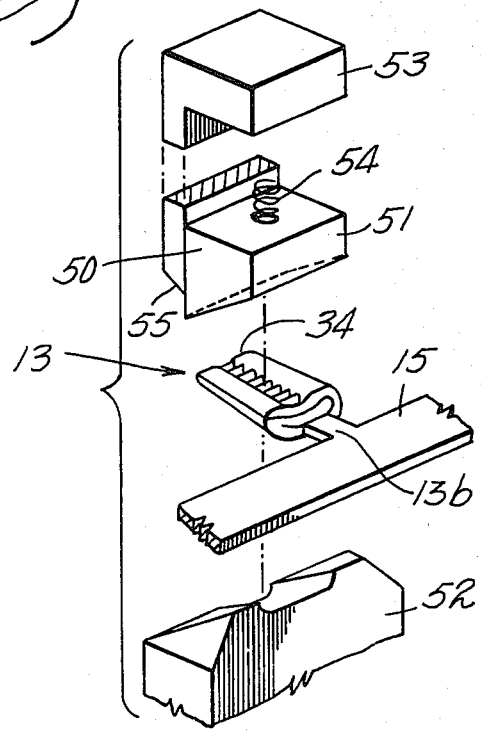
FIG. 6 is an enlarged view of stage 13 showing means for forming a bevel on the narrower end of the jaw.

FIG. 6 illustrates the punch for forming the bevel 34 in the mandrel jaw. This conventional punch assembly 50 includes a pusher 51 and a punch 53 separated by a spring 54. The pusher 51 presses the mandrel jaw downward into female die 52 thereby bending temporary support **13*b* and disposing the mandrel jaw at an angle relative to the runner support 15. At this point, pusher 51 is held stationary by the mandrel jaw and the female die, while punch 53 continues its downward motion, compressing spring 54. As cutting edge 55 of punch 53 strikes the mandrel jaw, bevel 34** is formed on its narrower end.

It is apparent that modifications and changes can be made within the spirit and scope of the present invention, but it is our intention, however, only to be limited by the scope of the appended claims.

Having thus described our invention, what we claim as new and desire to secure by Letters Patent of the United States is:

1. A mandrel pulling jaw for setting rivets, said jaw comprising:

a central body formed with a generally triangular flat surface and a conical outer surface;

a first and a second arm attached to said body, said first arm being shorter than said second arm, said first arm being folded over and disposed upon said body and said second arm being folded over and disposed upon said first arm;

a central groove disposed within said jaw and extending longitudinally from the apex of said body to the base and a plurality of teeth disposed transversely to said groove.

2. The jaw according to claim 1 wherein said second arm is longer than said first arm by substantially the thickness of said first arm.

3. The jaw according to claim 1 wherein each end of the jaw has a flat side inclined towards the other end and towards the groove.

4. A process of forming a mandrel jaw from a strip of metal, the steps which comprises;

forming a body having a first and a second arm extending therefrom;

folding said first arm over said body and then folding said second arm over said first arm;

stamping said body into a generally conical shape with a flat surface on a plane parallel with the axis of the cone and stamping a central groove along the axis of said cone and forming teeth transverse with said axis so as to form said jaw.

5. The process according to claim 4 wherein said body is attached to temporary supports during the forming and stamping operations.

6. The process according to claim 5 wherein the temporary supports are sheared after stamping the body and groove.

7. The process according to claim 4 wherein said central body has a generally triangular shape and each of said arms extend from the sides of said triangle.

8. The process according to claim 4 wherein inclined flat surfaces are stamped into the ends of the jaw, said surfaces being inclined towards each other and towards said central groove.

9. A mandrel pulling jaw for use in a rivet setting tool, comprising a body with a generally triangular flat inner surface having a central groove extending longitudinally from the apex of said body to its base and a substantially conical outer surface, characterized by the fact that said jaw is formed of a central body portion, a first arm on one side of, integral with, and folded over so as to be disposed upon said central body portion, and a second arm on the side opposite said first arm and integral with said central body portion, said second arm being folded over and disposed upon said first arm.

10. A jaw according to claim 9, characterized by the fact that the second arm is longer than the first arm.

11. A jaw according to claim 10, characterized by the fact that the length of the second arm exceeds that of the first arm by substantially the thickness of the first arm.

12. A jaw according to claim 9, characterized in that the axial end portions of said jaw have flat surfaces inclined toward each other and toward said central groove.

13. A method of making a mandrel pulling jaw, characterized by the steps of forming a central body portion in a strip of metal, said body portion being of generally triangular shape and having a first and a second arm extending on opposite sides therefrom, folding said first arm over said body portion from one side, folding said second arm over said first arm from the opposite side, stamping said body with said arms folded thereon into a generally conical shape and forming a flat surface on a plane parallel with the axis of the cone, and stamping a central groove in said flat surface along the axis of said cone.

14. Method as claimed in claim 13, characterized by the fact that axial end portions of said central body portion remains attached to temporary supports during the forming and stamping operations.

15. Method according to claim 14, characterized in that said temporary supports are removed upon completion of said forming and stamping operations.

16. Method according to claim 13, characterized in that flat surfaces, inclined toward each other, and toward said central groove, are formed at the axial end portions of said jaw.

* * * * *